United States Patent [19]

Kondo et al.

[11] Patent Number: 4,531,851

[45] Date of Patent: Jul. 30, 1985

[54] MARK DETECTOR FOR PRINTERS

[75] Inventors: Kouichi Kondo; Tadahisa Oikawa, both of Iwate, Japan

[73] Assignee: Kabushiki Kaisha Sato, Japan

[21] Appl. No.: 528,079

[22] Filed: Aug. 13, 1983

[30] Foreign Application Priority Data

Sep. 6, 1982 [JP] Japan ..... 57-153979

[51] Int. Cl.[3] ..... B41J 11/46

[52] U.S. Cl. ..... 400/583.3; 400/580; 400/708; 400/120; 101/288; 250/548

[58] Field of Search ..... 400/120, 583.3, 580, 400/282, 708, 613.3, 618, 581; 156/387, 384, DIG. 46, DIG. 47; 250/548, 557; 101/288, 291, 292; 242/75.2, 149

[56] References Cited

U.S. PATENT DOCUMENTS

| | | | |
|---|---|---|---|
| 134,042 | 12/1872 | Dyer | 101/291 |
| 2,110,605 | 3/1938 | Mabon | 400/619 X |
| 2,792,778 | 5/1957 | Schlegel et al. | 101/292 X |
| 3,060,850 | 10/1962 | Dewyer | 101/288 |
| 3,586,149 | 6/1971 | Miller | 400/618 |
| 4,248,151 | 2/1981 | Real | 101/288 |
| 4,265,176 | 5/1981 | Sato | 101/291 X |
| 4,268,179 | 5/1981 | Long et al. | 400/120 |
| 4,387,380 | 6/1983 | Asakura et al. | 400/120 X |

FOREIGN PATENT DOCUMENTS

| | | | |
|---|---|---|---|
| 1162883 | 8/1969 | United Kingdom | 101/292 |

*Primary Examiner*—Edgar S. Burr
*Assistant Examiner*—Charles A. Pearson
*Attorney, Agent, or Firm*—Ostrolenk, Faber, Gerb & Soffen

[57] ABSTRACT

In order to control the movement of a label web to be imprinted past the printing head of a thermal printer, or the like, the label web carries optically detectable marks at predetermined intervals therealong. The label web is comprised of label pieces adhesively secured to an underlying supporting web. An optical sensor for detecting the marks on the label web is disposed on a label holding member which is hinged to a supporting base, so that the label web is fed past the supporting base and is pressed thereagainst by the label holding member. Holes located on the supporting base at opposite sides of the label web help remove any adhesive material that is emitted from the sides of the label web. The support base has guiding lands for guiding the movement of the label web. The operation of the printer and of the label feed device is controlled by the optically sensed marks on the web.

11 Claims, 5 Drawing Figures

MARK DETECTOR FOR PRINTERS

BACKGROUND OF THE INVENTION

1. Field of the Invention

The present invention relates to a printer and, more particularly, to a mark detector for detecting the marks which are formed on a label web used as a recording medium of the printer.

2. Description of the Prior Art

In supermarkets or the like, labels indicating the prices and other aspects of commodities are printed and then adhered to the commodities by means of a portable type label printing and applying machine which is called the "hand labeler". When the labels are to be printed with bar codes, that are used in the POS system which has become popular in recent years, the bar codes are required to have high printing accuracy. For such bar code printing, the hand labeler is often not used. Instead, the printing is frequently done by a table type printer.

The labels are supplied in the form of web comprising a number of labels temporarily adhered in series to a web-shaped strip of backing paper. In order to control the label printing and the feed of the label web within the printer, its operation is controlled by forming the label web in advance with marks at predetermined intervals and by detecting those marks by means of an optical sensor.

The label web so marked is guided to pass through the detecting portion of the optical sensor by guide rollers, for example. Just below the sensor of that detecting portion, however, the label web may float or meander while it is running, so that the marks cannot be correctly detected. This may often result in troubles in the operation of the printer.

SUMMARY OF THE INVENTION

An object of the present invention is to provide a mark detector for a printer, which is enabled to accurately detect the marks formed on a label web, by preventing the label web from floating and meandering at the detecting portion of the printer, so that the operation of the printer may be smoothly conducted.

The present invention is used in a printer for printing a label web comprising a multiplicity of labels temporarily adhered in series to a web-shaped strip of backing paper by means of an adhesive and which web is formed with marks at predetermined intervals. The printer includes a mark detector for controlling the printing and the feed of the label web. The detector comprises detecting means, including an optical sensor for detecting the marks on the label web. The label web is fed onto a supporting base. A label holding member hinged to the supporting base holds the label web on the supporting base and floating guide lands on the base at the edges of the label web prevent meander. Adhesive removing means mounted on the two sides of the supporting base remove any adhesive, which may come out of the sides of the label web. The detector is connected with the label web feed means for causing periodic feeding of the label web to bring successive labels to a printing position and for then halting label web feeding. The printing means is connected with the detector for printing a label of the halted label web.

BRIEF DESCRIPTION OF THE DRAWINGS

Other objects, features and advantages of the present invention will become apparent from the following description taken in conjunction with the accompanying drawings, in which.

DESCRIPTION OF THE PREFERRED EMBODIMENT

Figure 1:
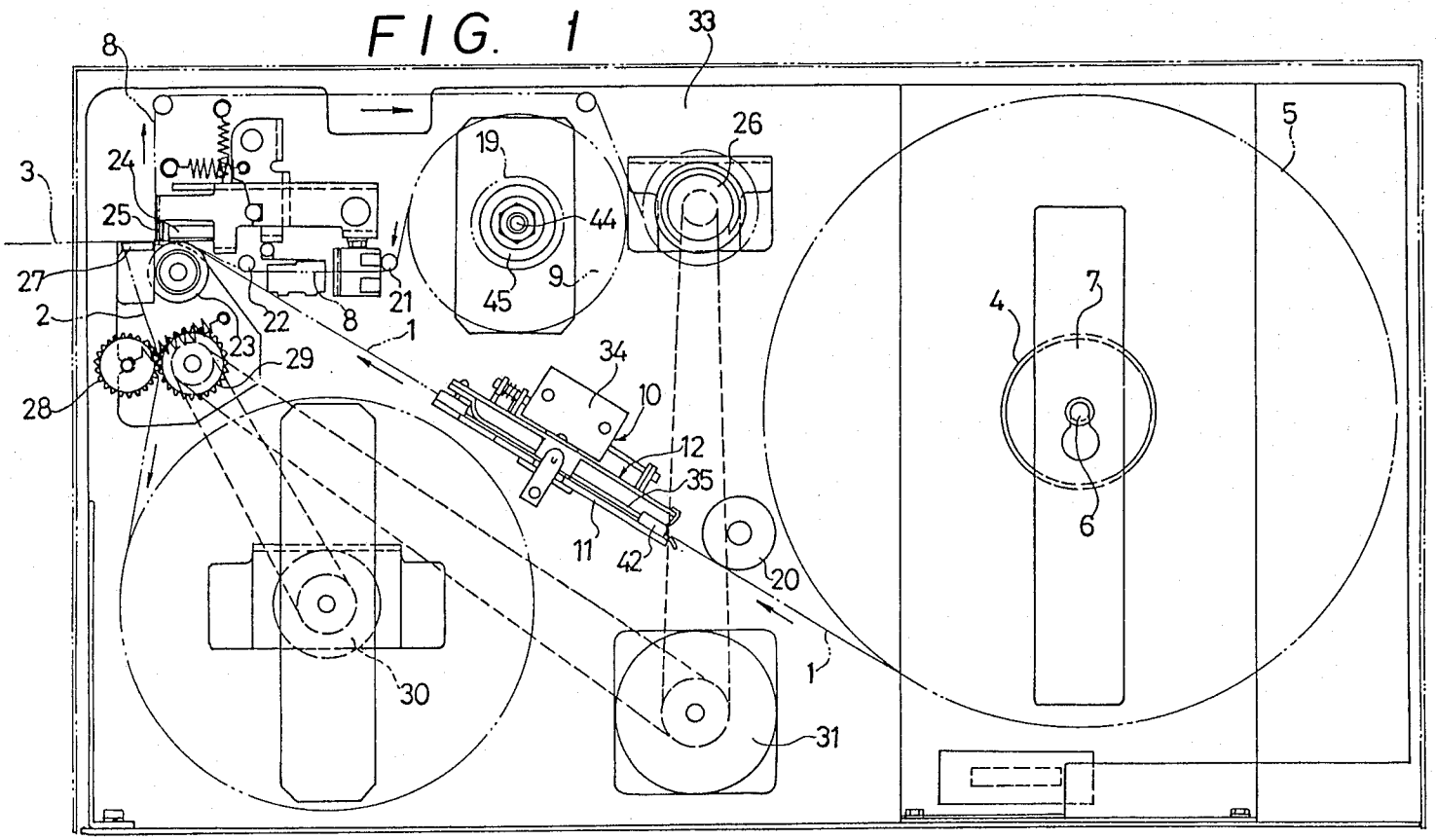
FIG. 1 is a schematic view showing the internal construction of a thermal printer which is equipped with a mark detector according to the present invention.

FIG. 1 shows a heat transfer type thermal printer as one example of a printer to which the present invention is applied. A label web 1 comprises a number of labels 3 in series which are temporarily adhered by means of an adhesive to web-shaped backing paper 2 having a peeling property. There is also a web-shaped heat-activated carbon ribbon 8. The web 1 and ribbon 8 are fed in an overlapping manner to a thermal head 24, and the heat-activated ink of the carbon ribbon 8 is melted by the thermal head 24 and is transferred to the labels 3 for producing desired prints.

The label web 1 and carbon ribbon 8 are attached in the form of respective feed rolls 5 and 9, which are wound on respective reels 4 and 19, and these are carried on the outer circumferences of respective core members 7 and 45 which are rotatably fitted on respective fixed shafts 6 and 44.

The label web 1 being let off the feed roll 5 is guided through a guide roller 20 and a later-described mark detector 10 of the present invention to a platen roller 23. The carbon ribbon 8 being let off the feed roll 9 is guided through guide rollers 21 and 22 to the platen roller 23. The label web and the carbon ribbon are overlapped at the platen roller 23 and are printed there by the action of the thermal head 24. After printing, the carbon ribbon 8 is turned upward by the action of a holding member 25 until it is taken up upon a carbon ribbon take-up shaft 26.

Meanwhile, the label web 1 is turned downward at the leading or downstream end of a turning member 27 so that only the backing paper 2 of the label web is guided to pass between a pair of toothed rollers 28 and 29 until it is taken up upon a backing paper take-up shaft 30. The labels are advanced on the backing paper, are peeled from the backing paper 2 at the turning member 27 and are brought into states in which they can be applied to articles such as commodities.

A drive motor 31 is connected through belts to the carbon ribbon take-up shaft 26 and the toothed roller 29, and the latter roller is in turn connected to the backing paper take-up shaft 30.

Figure 2:
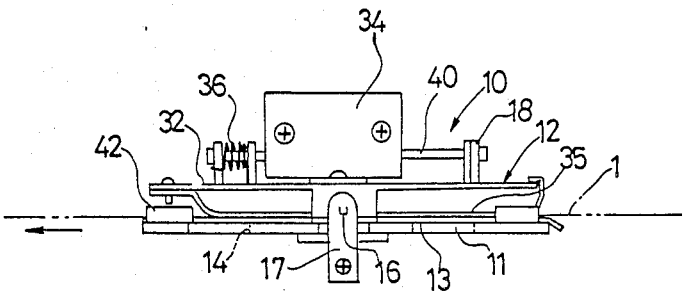
FIG. 2 is a front elevational view showing the mark detector of the present invention.
Figure 3:
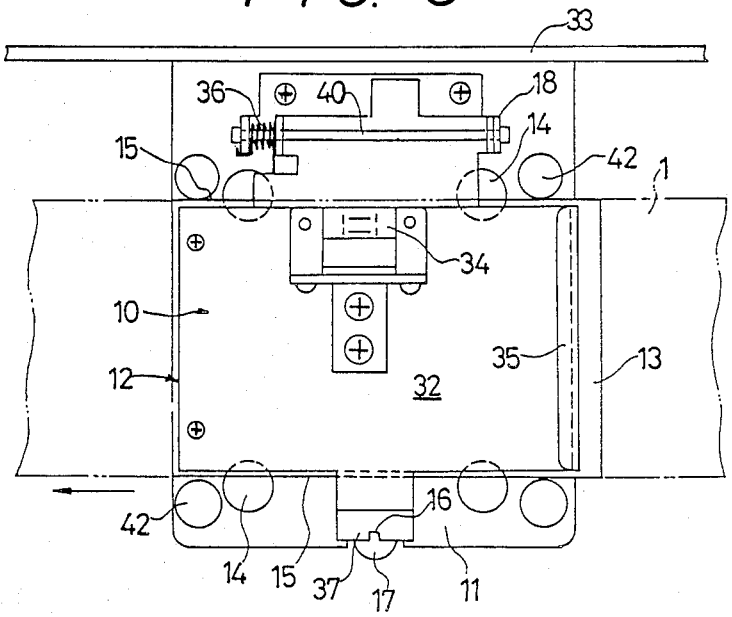
FIG. 3 is a top plan view showing the mark detector of FIG. 2.
Figure 4:
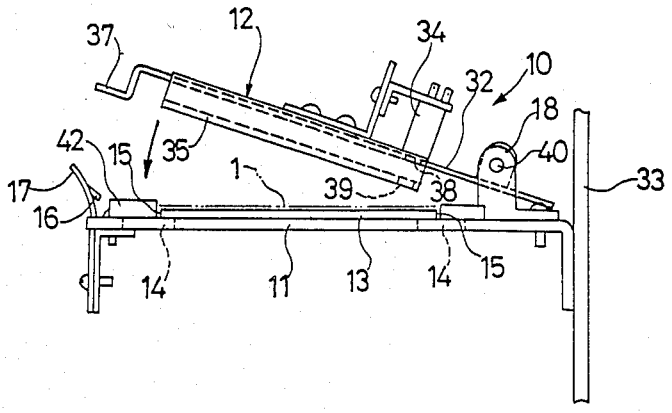
FIG. 4 is a side elevational view showing the mark detector of FIGS. 2 and 3, with its label holding member opened.

The mark detector 10 of the present invention is described with reference to FIGS. 2–4. The mark detector 10 has a supporting base 11, which is secured to the frame 33 of the printer. A label holding member 12 is hinged at one edge to the supporting base 11.

The upper face of the supporting base 11 has affixed to it a label bearing plate 13, which has substantially the same width as the label web 1. The supporting base 11 has two pairs of adhesive removing through holes 14 which are positioned in the vicinity of the two side edges of the label bearing plate 13 toward the leading and trailing ends of the plate. The removing holes 14 form an adhesive removing portion together with stepped portions 15 which are formed at the two side edges of the label bearing plate 13.

At the four corners of its upper face, the supporting base 11 is further formed with column-shaped guide lands 42 for preventing the label web 1 from meandering laterally.

To one side end portion of the supporting base 11 (i.e., at the left in FIG. 4), there is attached a lock spring 17 which is formed with an engagement tongue 16 generally at its central portion. At the opposite side end portion of the supporting base 11 are formed a pair of pin mounting posts 18 which support a horizontal pin 40 for hinging one end of a holding plate 32 of the label holding member 12.

A reflective type optical sensor 34 is integrally attached to the upper face of the holding plate 32 of the label holding member 12. On the lower face of the holding plate 32 is mounted a depressing leaf spring 35 which has one end fixed to the holding plate 32. A coil spring 36 is wound on the pin 40 for always urging the label holding member 12 as a whole in the clockwise direction, as viewed in FIG. 4. The holding plate 32 has an engagement portion 37 formed at its leading end for being brought into engagement with and to lock under the engagement tongue 16 of the lock spring 17 when the label holding member 12 is swung in the counterclockwise direction, as viewed in FIG. 4. The holding plate 32 and the holding leaf spring 35 are formed with optical apertures 38 and 39, respectively, just below the optical sensor 34 for enabling the sensor 34 to detect marks on the labels of the label web beneath it.

Figure 5:
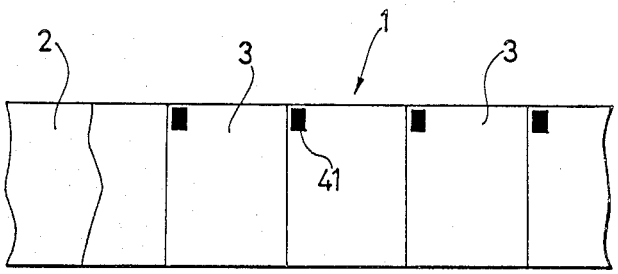
FIG. 5 is a top plan view showing a label web to be used with the mark detector shown in FIGS. 2–4.

The label web 1 to be used with the mark detector of the present invention must be formed at predetermined intervals with the marks which are to be detected by the optical sensor 34. As shown in FIG. 5, for example, one corner of each label 3 is printed in advance with a black mark 41.

The marks 41 of the label web may alternatively be formed on the lower face of the label web. In this modification, the sensor 34 has to be disposed below the supporting base 11.

The operation of the mark detector of the present invention is now described. When the label web 1 is to be fed, the mark detector 10 releases the engagement between the engagement portion 37 and the lock spring 17, as shown in FIG. 4, to bring the label holding member 12 into its upswung open position. The label web 1 being let off the feed roll 5 is pulled between the guide lands 42 of the supporting base 11 until it is placed upon the label bearing plate 13. Then, the label holding member 12 is swung counterclockwise to bring its leading end engagement portion 37 into engagement to lock the engagement tongue 16 of the lock spring 17. As a result, the label depressing leaf spring 35 of the label holding member 12 lightly depresses substantially the whole face of the label web 1 so as to avoid label web floating and to avoid trouble in the feed of the label web 1.

When the thermal printer is now operated, the backing paper take-up shaft 30, the toothed roller 29 and the carbon ribbon take-up shaft 26 are driven by the drive motor 31, thereby to feed and take up the label web 1 and the carbon ribbon 8 at an equal speed. During these feeds, when the sensor 34 of the mark detector 10 senses the marks 41 on the labels 3 through the optical apertures 38 and 39, a signal is sent to a control unit (not shown) connected with the thermal head, and the printing operations are conducted in response to the instructions coming from the control unit. The exothermic element of the thermal head 34 generates heat to melt the heat-activated ink of the carbon ribbon 8 and transfers the melted ink to the labels 3 of the label web 1 so that the desired prints are obtained. The webs 1 and 8 may be fed continuously and the head would be operated periodically while the webs are feeding. Alternatively, the shafts 30 and 26 for the backing paper and the carbon ribbon may be operated intermittently under the control of the control unit and the thermal head will make the print after the label web feed has temporarily halted.

As has been described hereinbefore, according to the present invention, the detector for the marks formed on the label web is equipped with a label holding member for holding the label web on the supporting base of the detector. As a result, the label web is prevented from floating and meandering, enabling accurate detection of the marks by the sensor so that the operations of the printer can be smoothly conducted.

Because the label holding member holds the label web, any adhesive which may come out of the two side edges of the label web, is removed by the action of the adhesive removing portion so that any trouble, which might otherwise be caused by that escaping adhesive, can be obviated.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A printer for printing labels in a label web, wherein the labels of the web have optically detectable marks thereon at predetermined intervals, the printer comprising:

printing means for applying imprints on the label web;

a supporting base spaced from the printing means along the path of feed of the label web, and to which and past which the label web is fed; feed means for feeding the label web to and past the supporting base and also to and past the printing means;

a label web holding member supported to the base for holding the face of the label web to the base as the label web is fed to and past the base;

an optical detector in the area of the label web holding member for detecting the marks on the label web; the detector being connected with the printing means for controlling the timing of the printing of the label web by the printing means;

guide means at the supporting base for guiding the feeding of the label web past the supporting base and for preventing the label web from meandering laterally;

the label holding member including depressing means for depressing the face of the label web onto the supporting base in the area of the optical detector;

the label holding member being hingedly attached to the base at one lateral side of the label web for causing the depressing means to hold the label web to the base when the label holding member is hingedly moved toward and is at the base and for enabling the labelholding member to be hingedly lifted away from the base, enabling placement of the label web on the base and removal of the label web therefrom;

locking means for locking the label holding member at the supporting base in a position for the depressing means to hold the label web to the supporting base; the locking means including an engagement portion formed at the opposite lateral side of the label holding member from the hinged attached one side thereof, and including a locking element on the base for engaging the engagement portion on the label holding member; and a spring connected at the label holding member for normally biasing it to hingedly lift off the supporting base and out of a position which holds the label web to the supporting base.

2. The printer of claim 1, wherein the label web comprises a plurality of labels adhered by an adhesive in series to a web of supporting material;

the supporting base including adhesive removing means at a side of the base along which the web is fed, for removing adhesive which may be emitted from the side of the label web and which is present at the side of the label web while the label web is at the supporting base.

3. The printer of claim 2, wherein the adhesive removing means includes a pair of removing holes formed at the opposite sides of the supporting base past which the label web moves.

4. The printer of claim 3, further comprising a pair of web guiding step portions formed along the lateral side edges of the base past which the label web moves.

5. The printer of claim 1, wherein the locking element includes a locking spring formed at the supporting base at the same side of the holding member as the engagement portion; an engagement tongue formed on the locking spring for hooking the engagement portion of the holding member while the holding member is in position to hold the label web to the base.

6. The printer of claim 1, wherein the guide means includes guide lands formed at the opposite sides of the base for guiding passage of the label web past the supporting base.

7. The printer of claim 1, wherein the depressing means includes a leaf spring having one end fixed to the label holding member and having another end for contacting the label web being fed for biasing the label web toward the supporting base.

8. The printer of claim 1, wherein the detecting means is located prior to the printing means in the path of feeding of the label web by the feeding means.

9. The printer of claim 1, wherein the printing means comprises a thermal printer; the thermal printer comprises a printing head, and the feed means feeds the label web past the printing head; a source of heat-activated printing ink being movable between the printing head and the label web, and the printing head being movable against the printing ink source and the label web for transmitting heat-activated ink from the source of ink to the label web.

10. The printer of claim 1, wherein the supporting base has four corners, the guide means including four guide lands, each of the guide lands being formed at a respective corner of the supporting base.

11. The printer of claim 1, wherein the label holding member is further for holding substantially the whole face of the label web to the supporting base in the area of the optical detector, the depressing means being for depressing substantially the whole face of the label web onto the supporting base in the area of the optical detector.

* * * * *

UNITED STATES PATENT AND TRADEMARK OFFICE

CERTIFICATE OF CORRECTION

PATENT NO. : 4,531,851
DATED : July 30, 1985
INVENTOR(S) : Kouichi Kondo; Tadahisa Oikawa It is certified that error appears in the above–identified patent and that said Letters Patent are hereby corrected as shown below:

On the title page the filing date which is "August 13, 1983" should read -- August 31, 1983 --.

Signed and Sealed this

*Fifth* Day of *November 1985*

[SEAL]

*Attest:*

*Attesting Officer*

DONALD J. QUIGG

*Commissioner of Patents and Trademarks*